United States Patent [19]

Nishibayashi et al.

[11] 4,388,396

[45] Jun. 14, 1983

[54] ELECTROPHOTOGRAPHIC PROCESS OF DEVELOPING AND TRANSFERING IMAGES USES FLUORINE CONTAINING OFFSET PREVENTING AGENT IN DEVELOPER

[75] Inventors: Hatsumi Nishibayashi, Hirakata; Yoshimi Amagai, Katano; Norio Hikake, Kyoto; Toshihiro Kouchi, Hirakata; Tatsuo Aizawa, Osaka, all of Japan

[73] Assignee: Mita Industrial Company Limited, Osaka, Japan

[21] Appl. No.: 368,728

[22] Filed: Apr. 15, 1982

Related U.S. Application Data

[62] Division of Ser. No. 893,338, Apr. 4, 1978.

[30] Foreign Application Priority Data

Apr. 7, 1977 [JP] Japan ..... 52-39015

[51] Int. Cl.[3] ..... G03G 13/06; G03G 13/14

[52] U.S. Cl. ..... 430/126; 430/110; 430/99; 430/107

[58] Field of Search ..... 430/107, 48, 126, 99

[56] References Cited

U.S. PATENT DOCUMENTS

| | | | |
|---|---|---|---|
| 3,431,412 | 3/1969 | Okubo et al. | 430/110 X |
| 3,809,554 | 8/1974 | Merrill et al. | 430/110 X |
| 3,948,654 | 4/1976 | Fisher | 430/110 X |
| 4,051,077 | 9/1977 | Fisher | 430/110 X |
| 4,075,362 | 2/1977 | Concannon | 427/22 |

OTHER PUBLICATIONS

Pittman, "Surface Properties of Fluorocarbon Polymers", Wall, Fluoropolymers, pp. 419–421, (1972), Wiley Intersci.

*Primary Examiner*—John D. Welsh

*Attorney, Agent, or Firm*—Sherman & Shalloway

[57] ABSTRACT

A developer for electrostatic images consisting essentially of particles comprising a pigment, a binder and an offset-preventing agent selected from the group consisting of aliphatic fluorocarbon compounds and fluorochlorocarbon compounds is disclosed. When this developer is used, a high offset-preventing effect can be attained at the fixing step even if the amount incorporated of the offset-preventing agent is small, and further, the developing operation can be performed in good conditions. By incorporation of this offset-preventing agent, the flowability of particles of the developer and charge characteristics of the developer can be remarkably improved.

22 Claims, No Drawings

ELECTROPHOTOGRAPHIC PROCESS OF DEVELOPING AND TRANSFERING IMAGES USES FLUORINE CONTAINING OFFSET PREVENTING AGENT IN DEVELOPER

This is a division of application Ser. No. 893,338, filed Apr. 4, 1978.

BACKGROUND OF THE INVENTION (1) Field of the Invention

The present invention relates to a developer for electrostatic images. More particularly, the invention relates to a developer for elastrostatic images, which shows a good flowability at the developing step and a high offset resistance at the fixing step.

(2) Description of the Prior Art

A so-called magnetic brush method has been frequently adopted as one developing method for developing an electrostatic latent image formed by the electrostatic photography. As the developer for this magnetic brush developing method, there are ordinarily used a so-called two-component type developer comprising a blend of a powdery magnetic carrier such as iron and toner particles formed by dispersing a pigment in a binder medium, and a so-called one-component type developer composed of electrically conductive magnetic particles formed by dispersing a fine powder of a magnetic material such as triiron tetroxide, optionally with other pigment, into a binder resin and rendering the surfaces of the particles electrically conductive according to need. Toner particles or particles of a one-component type developer applied to an electrostatic image are transferred directly on a photosensitive sheet for electrostatic photography or optional on a transfer sheet, and then, they are fixed according to appropriate heating means.

From the viewpoints of the thermal efficiency, preventing of such accidents as fires and the operation speed at the fixing step, a method in which fixation is carried out under heat and pressure by using a roll is advantageous for heat fixation of developer particles. However, according to this fixation method, since an image of the developer particles is contacted with the surface of the fixing roller under heating and compression, there is caused a so-called offset phenomenon that parts of developer particles are transferred on the surface of the fixing roller, and the so transferred particles are re-transferred on a sheet on which the image is fixed, resulting in contamination of a photosensitive plate or transfer sheet.

For preventing occurrence of this disadvantage, there has been adopted means of covering the surface of the fixing roller with a material having an excellent parting property or a high stain resistance, such as a fluorine resin, and forming a film of an offset-preventing liquid such as a silicone oil on the surface of the fixing roller. However, when such means is adopted, the mechanism of the fixing apparatus is complicated and it is difficult to supply the offset-preventing liquid precisely in correspondence to the copying or printing operation.

As means for overcoming these defects, there has already been tried a process in which a substance capable of acting as a parting agent is incorporated in developer and at the fixing step using a roller, the substance is set free in the form of a liquid on the surfaces of the developer particles to thereby prevent occurrence of the offset phenomenon. For example, Japanese Patent Publication No. 3304/77 discloses a toner for developing electrostatic images comprising a coloring agent, a styrene resin and a low-molecular-weight polypropylene. This toner is advantageous in that by using a fixing roller to which an offset-preventing liquid is not supplied, the fixing operation can be performed at a high efficiency in good conditions while preventing occurrence of the offset phenomenon. However, this toner is still insufficient or unsatisfactory in properties required for development.

More specifically, in the toner of this type, it is indispensable that a parting substance should be liquefied and set free on the surfaces of toner particles at the fixing step. Therefore, it is necessary that a relatively large amount of the parting substance should be incorporated in toner particles. If the parting substance is incorporated in a large quantity in toner particles, the flowability and charge characteristics of the toner particles are drastically reduced. Most of parting substances used for this purpose are soft in the normal state, and toner particles containing such parting agent in the surface portion tend to agglomerate and the toner has not a sufficient flowability for coating the toner uniformly on a magnetic brush-forming developing roller (sleeve). For example, agglomerates or masses of the toner particles are formed on the surface of the sleeve, and falling of such agglomerates or masses causes contamination of the background. Moreover, unevenness of adhesion of the toner particles to the surface of the sleeve, blurring is readily caused in the obtained image.

Electrostatic images formed according to a commercial electrostatic photocopying or printing process are generally negatively charged, and therefore, toner particles having a positive charge polarity are customarily used. Most of parting agents incorporated in relatively large quantities in toner particles have bad influences on the above charge characteristics of the toner particles. For example, we have confirmed that the above-mentioned polypropylene has a function of reducing the property of being positively charged in the toner particles.

This disadvantage by incorporation of a relatively large amount of the parting substance in toner particles becomes conspicuous in an electrostatic photocopying process of the type where a toner image formed on an electrostatic photographic photosensitive plate is transferred onto a transfer sheet and this photosensitive plate is used repeatedly. More specifically, the parting substance present on the surfaces of the toner particles is transferred onto the surface of the photosensitive plate and gradually accumulated thereon, and finally, an electrically insulating layer is formed on the surface of the photosensitive plate. Therefore, when such toner is used, even if the photosensitive plate is used repeatedly only a limited number of times, fogging of obtained prints or electric breakdown of the photosensitive plate is caused by residual charges, and the life of the photosensitive plate is drastically shortened.

BRIEF SUMMARY OF THE INVENTION

We found that developer particles comprising pigment particles, a binder and an offset-preventing agent selected from the group consisting of aliphatic fluorocarbon compounds and fluorochlorocarbon compounds have a very excellent offset-preventing effect even though the amount incorporated of the offset-preventing agent is much smaller than the amounts of conventional parting agents incorporated in developer particles, and the flowability of the above developer particles is very excellent.

It is therefore a primary object of the present invention to provide a developer for electrostatic images which has hardly any tendency or no tendency of agglomeration of particles and has an excellent flowability and food charge characteristics, and by which the development operation can be performed in very good conditions and the phenomenon of offsetting developer particles to a fixing roller at the heat-fixing step can be effectively prevented.

Another object of the present invention is to provide a dry developer for electrostatic images in which by incorporation of an aliphatic fluorocarbon or fluorochlorocarbon compound, the tendency of agglomeration is much reduced as compared with developer particles free of such offset-preventing compound and the flowability is remarkably improved.

Still another object of the present invention is to provide a dry developer for electrostatic photography which can be effectively applied to an electrostatic photocopying process of the type where an image of a developer formed on an electrostatic photographic photosensitive plate is transferred onto a transfer sheet and the photosensitive plate is used repeatedly, while preventing effectively occurrence of fogging of prints or electric breakdown of the photosensitive plate by residual charges.

In accordance with the present invention, there is provided a developer for electrostatic images consisting essentially of particles comprising a pigment, a binder and an offset-preventing agent selected from the group consisting of aliphatic fluorocarbon compounds and fluorochlorocarbon compounds.

The developer of the present invention can be applied to not only a two-component type developer comprising toner particles combined with a carrier composed of a fine powder of a magnetic material such as iron powder but also a one-component type developer comprising particles in which a fine powder of a magnetic substance such as triiron tetroxide has been incorporated. In the instant specification and claims, the term "developer" is used to mean a concept including both the two-component type and one-component type developers, and the term "toner particles" is used to mean particles to be combined with a carrier and distinguish said particles from the one-component type developer.

DETAILED DESCRIPTION OF THE PREFERRED EMBODIMENTS

The present invention will now be described in detail.

COMPONENTS OF DEVELOPER

The present invention is based on the novel finding that an aliphatic fluorocarbon or fluorochlorocarbon compound is incorporated in a dry developer composition comprising pigment particles and a binder, an excellent offset-preventing effect can be attained at the fixing step even if the amount of this offset-preventing compound is much smaller than the amounts required of conventional parting agents, and further, the flowability and charge characteristics of the developer particles can be remarkably improved.

As the aliphatic fluorocarbon or fluorochlorocarbon compound, there are used substantially non-volatile liquid or solid compounds having an aliphatic fluorocarbon group, especially one represented by the following formula:

$$C_nF_{2n+1}- \quad (1\text{-a})$$

wherein n is a number of at least 4, preferably at least 5, especially preferably at least 8, or an aliphatic fluorochlorocarbon group, especially one represented by the following formula:

$$C_nF_pCl_q- \quad (1\text{-b})$$

wherein n is as defined above, and p and q each stand for a number of at least 1 with the proviso that (p+q) is equal to (2n+1).

In order for these compounds to be non-volatile, it is preferred that the average molecular weights of these compounds be at least 400, especially at least 500.

Suitable examples of such aliphatic fluorocarbon or fluorochlorocarbon compound include low-molecular-weight homopolymers and copolymers including recurring units of at least one member selected from ethylene tetrafluoride, propylene hexafluoride and ethylene trifluoride monochloride, especially oily or waxy polymers having a number average molecular weight of 400 to 2000, particularly 500 to 1500. These polymers are marketed under the tradenames "Polyflon Wax" and "Daifuroil" (products manufactured by Daikin Kogyo Kabushiki Kaisha) and they are easily available.

The aliphatic fluorocarbon or fluorochlorocarbon compound may include, in addition to a long-chain fluoroalkyl or fluorochloroalkyl group, at least one polar group selected from, for example, ether groups, hydroxyl groups, carboxyl groups, sulfonyl groups, amido groups, amino groups and quaternary ammonium groups at the molecule end or in the molecule chain.

The use of a fluorocarbon compound is especially preferred for attaining the objects of the present invention Especially valuable aliphatic fluorocarbon compounds are anionic, nonionic, cationic and amphoteric surface active agents having a long-chain fluoroalkyl group and derivatives thereof, and nonionic surface active agents of this type are most preferred. Specific examples of these preferred fluorocarbon compounds are as follows.

(a) Compounds represented by the following formula:

$$C_nF_{2n+1}SO_3M \quad (2)$$

wherein n is as defined above, and M stands for a hydrogen atom or a cation.

(b) Compounds represented by the following formula:

$$C_nF_{2n+1}SO_2\overset{\overset{\displaystyle R}{|}}{N}CH_2COOM \quad (3)$$

wherein n and M are as defined above, and R stands for a hydrogen atom or a lower alkyl group having up to 4 carbon atoms.

(c) Compounds represented by the following formula:

$$C_nF_{2n+1}SO_2\overset{\overset{\displaystyle R}{|}}{N}(R_2O)_m-H \quad (4)$$

wherein n and R are as defined above, $R_2$ stands for an alkylene group having 2 to 6 carbon atoms, especially 2 to 4 carbon atoms, and m is a number of from 2 to 22, especially from 5 to 22.

(d) Compounds represented by the following formula:

$$C_nF_{2n+1}SO_2NH—R_3—N^{\oplus}(R_4)_3.X^{\ominus} \quad (5)$$

wherein n is as defined above, $R_3$ stands for an alkylene group having 2 to 6 carbon atoms, $R_4$ stands for a lower alkyl group having up to 4 carbon atoms, and $X^{\ominus}$ is an anion.

(e) Compounds represented by the following formula:

$$C_nF_{2n+1}SO_2N(R_2OH)_2 \quad (6)$$

wherein n and $R_2$ are as defined above.

(f) Compounds represented by the following formula:

$$C_nF_{2n+1}—A—R_2O)_mR_5 \quad (7)$$

wherein n, m and $R_2$ are as defined above, A stands for a group $$—O—\underset{\underset{O}{\|}}{C}—NH—Y—NH—\underset{\underset{O}{\|}}{C}—O— \text{ or } —O—\underset{\underset{O}{\|}}{C}—Y—\underset{\underset{O}{\|}}{C}—O—,$$

a divalent aliphatic or aromatic hydrocarbon group, and $R_5$ stands for a lower alkyl group having up to 4 carbon atoms.

(g) Compounds represented by the following formula:

$$C_nF_{2n+1}—A—(R_2O)_{m-1}R_2—A—C_nF_{2n+1} \quad (8)$$

wherein n, A, $R_2$ and m are as defined above.

(h) Low-molecular-weight copolymers comprising units of a monomer represented by the following formula:

$$\begin{array}{l} \quad\;\; R \\ \quad\;\; | \\ CH_2{=}C \\ \quad\;\; | \\ COOC_nF_{2n+1} \end{array} \quad (9)$$

wherein n and R are as defined above, and units of a monomer represented by the following formula:

$$\begin{array}{l} \quad\;\; R \\ \quad\;\; | \\ CH_2{=}C \\ \quad\;\; | \\ COO(R_2O)_m—R_5 \end{array} \quad (10)$$

wherein R, $R_2$, $R_5$ and m are as defined above, optionally with other acrylic monomer such as ethyl acrylate or methyl methacrylate.

In the foregoing compounds, the cation M may be an alkali metal, an alkaline earth metal, zinc, aluminum, cadmium or lead, and an anion X may be a halide ion. Ethylene and propylene groups are preferred as the alkylene group $R_2$.

These fluorine type surface active agents are marketed under the tradename "Megafac" (products manufactured by Dainippon Ink Kagaku Kogyo Kabushiki Kaisha), and they are easily available.

The aliphatic fluorocarbon and fluorochlorocarbon compounds exemplified above may be used singly, or mixtures of two or more of them may be used. Aliphatic fluorocarbon compounds especially suitable for attaining the objects of the present invention are nonionic surface active agents, especially those having a long-chain fluoroalkyl group and polyalkylene oxide units.

As suitable examples of the compound (c) of the formula (4), there can be mentioned compounds represented by the following formula:

$$C_8F_{17}SO_2\overset{\overset{R}{|}}{N}(CH_2CH_2O)_qH$$

wherein R is a methyl group and q is a number of from 5 to 22, and these compounds are marketed under the tradename "Megafac F-141 to F-144".

As suitable compounds (f) and (g) of the formulae (7) and (8), there can be mentioned compounds represented by the following formula:

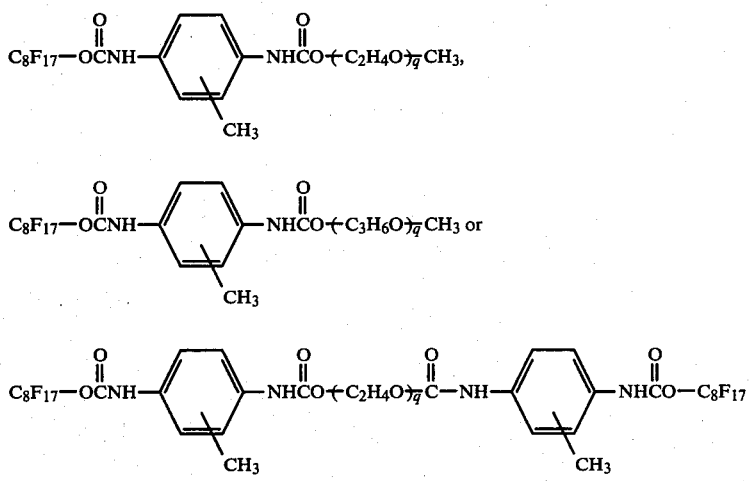

wherein q is as defined above, and these compounds are marketed under the tradename "Megafac F-180 to F-184". And as another suitable examples, there can be mentioned compounds represented by the following formula:

$$C_8F_{17}-\underset{\underset{O}{\|}}{OC_2H_4}-\underset{\underset{O}{\|}}{CO}\leftarrow C_3H_6O\rightarrow_q CH_3$$

wherein q is as defined above.

Among compounds (f) and (g), those having a urethane linkage can easily be prepared by reacting polyethylene glycol or polypropylene glycol with a diisocyanate other than tolylene diisocyanate, such as phenylene diisocyanate, 4,4'-diphenylmethane diisocyanate, xylylene diisocyanate, hexamethylene diisocyanate, lysine diisocyanate, 4,4'-methylene-bis(cyclohexyl isocyanate), trimethylhexamethyl diisocyanate, dimeric acid diisocyanate or methylcyclohexane diisocyanate, to form an isocyanate-terminated polyether having an isocyanate group at one or both of the molecule ends, and reacting the isocyanate-terminated polyether with a corresponding perfluoroalcohol.

Suitable examples of the compound (h) are marketed under the tradename "Megafac F-170 to F-173". In the present invention, copolymers comprising units of monomers of the formula (9) and (10) in an amount of 50 to 80% by weight based on the total units are preferably employed.

It is preferred that the above-mentioned aliphatic fluorocarbon or fluorochlorocarbon compound be used in an amount of 0.01 to 15% by weight, especially 0.05 to 10% by weight, particularly especially 0.1 to 5% by weight, based on the binder. When the amount of the fluorocarbon or fluorochlorocarbon compound is smaller than 0.01% by weight based on the binder, attainment of a substantial effect of preventing the offset phenomenon at the fixing step or improving the flowability cannot be expected. When the amount of the offset-preventing agent is larger than 15% by weight based on the binder, particles of the developer slip excessively, and at the developing step, it is difficult to draw up the developer by a developing roller or the like and the developing process becomes disadvantageous from the economical viewpoint. According to the present invention, as illustrated in Examples given hereinafter, a sufficient offset-preventing effect can be attained by the use of the offset-preventing agent in an amount much smaller than the amounts heretofore required of conventional lubricants and parting agents. This is one of characteristic features of the present invention.

Any of natural, semisynthetic and synthetic resins, rubbers and waxes showing an adhesiveness under application of heat or pressure can be used as the binder in the present invention. These resinous binders may be either thermoplastic resins or uncured thermosetting resins or precondensates thereof. As valuable natural resins, there can be mentioned, for example, balsam resins, rosin, shellac and copal. These natural resins may be modified with at least one of vinyl resins, acrylic resins, alkyd resins, phenolic resins, epoxy resins and oleo-resins, which will be described hereinafter. As synthetic resins, there can be mentioned, for example, vinyl resins such as vinyl chloride resins, vinylidene chloride resins, vinyl acetate resins, vinyl acetal resins, e.g., polyvinyl butyral, and vinyl ether polymers, acrylic resins such as polyacrylates, polymethacrylates, acrylic acid copolymers and methacrylic acid copolymers, olefin resins such as polyethylene, polypropylene, polystyrene, hydrogenated styrene resins, ethylene-vinyl acetate copolymers and styrene copolymers, polyamide resins such as nylon-12, nylon-6 and polymeric fatty acid-modified polyamides, polyesters such as polyethylene or terephthalate/isophthalate and polytetramethylene terephthalate/isophthalate, alkyd resins such as phthalic acid resins and maleic acid resins, phenol-formaldehyde resins, ketone resins, coumarone-indene resins, terpene resins, amino resins such as urea-formaldehyde resins and melamine-formaldehyde resins, and epoxy resins. These synthetic resins may be used in the form of mixtures of two or more of them, for example, phenolic-epoxy resins and amino-epoxy resins.

As the natural or synthetic rubber, there can be mentioned, for example, natural rubber, chlorinated rubber, cyclized rubber, polyisoprene, ethylene-propylene rubber (EPR), ethylene-propylene-diene rubber (EPDR), polybutadiene, butyl rubber, styrene-butadiene rubber (SBR) and acrylonitrile-butadiene rubber (ABR).

As the natural, synthetic or modified wax, there can be mentioned, for example, paraffin wax, petrolatum, polyethylene wax, microcrystalline wax, bees wax, lanoline, cotton wax, carnauba wax, montan wax, hydrogenated beef tallow, higher fatty acids, higher fatty acid amides, various soaps and other higher fatty acid derivatives.

As binders preferred for attaining the objects of the present invention, there can be mentioned, in the order of importance, homopolymers and copolymers of vinyl aromatic hydrocarbons, especially monomers represented by the following formula:

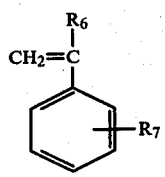

(11)

wherein $R_6$ stands for a hydrogen atom or a lower alkyl group having up to 4 carbon atoms, and $R_7$ stands for a hydrogen atom or a lower alkyl group having up to 4 carbon atoms, for example, styrene, α-methylstyrene and vinyltoluene, copolymers of the above monomers with other monomers, especially acrylic acid esters, methacrylic acid esters, acrylonitrile, ethylene, butadiene, isoprene or the like, various acrylic resins, polyester resins and polyamide resins.

In the present invention, the foregoing binders may be used singly or mixtures of two or more of them may be used. For example, a mixture of two or more of resins may be used, and in case of a developer of the pressure fixation type, a mixture of a resinous binder and a wax binder can be used.

In the present invention, at least one member selected from coloring pigments, extender pigments, magnetic pigments and electrically conductive pigments is used as the pigment. Of course, pigments having at least two of the above-mentioned functions can be used. For example, carbon black having a function as a black pigment and a function as an electrically conductive pigment and triiron tetroxide having a function as a magnetic function and a function as a black pigment, as seen from its another name "black iron", can be used in the present invention.

Suitable examples of the coloring pigment that can be used in the present invention are as follows:

Black Pigments:

Carbon black, acetylene black, lamp black and aniline black.

Yellow Pigments:

Chrome yellow, zinc yellow, cadmium yellow, yellow iron oxide, Mineral Fast Yellow, nickel titanium yellow, naples yellow, Naphthol Yellow S, Hansa Yellow G, Hansa Yellow 10G, Benzidine Yellow G, Benzidine Yellow GR, Quinoline Yellow Lake, Permanent Yellow NCG and Tartrazine Lake.

Orange Pigments:

Chrome orange, molybdenum orange, Permanent Orange GTR, Pyrazolone Orange, Vulcan Orange, Indanthrene Brilliant Orange RK, Benzidine Orange G, Indanthrene Brilliant Orange GK.

Red Pigments:

Red iron oxide, cadmium red, red lead, mercury sulfide, cadmium, Permanent Red 4R, Lithol Red, Pyrazolone Red, Watchung Red calcium salt, Lake Red D, Brilliant Carmine 6B, Eosine Lake, Rhodamine Lake B, Alizarine Lake and Brilliant Carmine 3B.

Violet Pigments:

Manganese violet, Past Violet B and Methyl Violet Lake.

Blue Pigments:

Prussian blue, cobalt blue, Alkali Blue Lake, Victoria Blue Lake, Phthalocyanine Blue, metal-free Phthalocyanine Blue, partially chlorinated Phthalocyanine Blue, Fast Sky Blue and Indanthrene Blue BC.

Green Pigments:

Chrome green, chromium oxide, Pigment Green B, Malachite Green Lake and Fanal Yellow Green G.

White Pigments:

Zinc flower, titanium oxide, antimony white and zinc sulfide.

As the extender pigment that can be used in the present invention, there can be mentioned, for example, baryte powder, barium carbonate, clay, silica, white carbon, talc and alumina white.

As the magnetic pigment, there are known triiron tetroxide ($Fe_3O_4$), diiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodium iron oxide ($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co) and nickel powder (Ni). Any of fine powders of these known magnetic substances can be used as the magnetic pigment in the present invention. A magnetic pigment especially suitable for attaining the objects of the present invention is triiron tetroxide.

As the electrically conductive pigment, there can be used any of inorganic fine powders which per se are not electrically conductive but have been rendered electrically conductive by the conducting treatment and various metal powders, in addition to the above-mentioned carbon black.

The amount of the pigment can be changed in a relatively broad range according to the intended use of the developer, but in general, the pigment is incorporated in an amount of 1 to 300% by weight based on the binder. In case of a two-component type developer, namely when the developer is used as the toner to be combined with a magnetic carrier, it is preferred that a coloring pigment be used in an amount of 1 to 15% by weight, especially 2 to 10% by weight, based on the binder, and in case of a one-component type magnetic, electrically conductive developer, it is preferred that a magnetic pigment be used in an amount of 50 to 300% by weight, preferably 100 to 250% by weight, based on the binder. In the latter case, a coloring pigment or electrically conductive pigment such as carbon black may be used in an amount of 1 to 15% by weight, especially 2 to 8% by weight, based on the binder in combination with the magnetic pigment according to need.

Known additives may be incorporated into the developer of the present invention according to known recipes. For example, in case of a two-component type developer, a known charge controlling agent, for example, an oil-soluble dye such as Nigrosine Base (CI 5045), Oil Black (CI 26150) or Spilon Black, a metal salt of naphthaenic acid, a fatty acid metal soap, a resin acid soap or a vinylpyridine homopolymer or copolymer may be incorporated in an amount of 0.1 to 5% by weight based on the binder.

PREPARATION OF PARTICLES OF DEVELOPER

The developer of the present invention can be prepared by any optional known means except that the above-mentioned components of the developer are used.

For example, the developer of the present invention can be prepared according to a process comprising dry-blending the foregoing components of the developer, fusing and kneading the resulting composition at a temperature higher than the melting point of the binder by using a kneading device such as a hot roll, a mixer or a kneader, cooling the kneaded mixture to room temperature or a lower temperature, pulverizing the cooled mixture by a pulverizer such as a jet mill, a roll mill or a pin mill and sieving the pulverized product according to need. The aliphatic fluorocarbon or fluorochlorocarbon compound may be incorporated as it is or in the form of a solution. It may be added prior kneading or during kneading.

Instead of the above fuse-kneading process, there may be adopted a process in which the respective components of the developer are stirred under conditions generation heat of friction in a high-speed stirrer such as a supermixer to obtain developer particles in which the respective components are integrated by fusion.

Further, instead of the process in which the cooled mixture is pulverized, there may be adopted a process in which a molten mixture of the respective components of the developer may be directly formed into developer particles by such means as spray granulation or centrifugal granulation.

Still further, there may be adopted a process in which the binder and the aliphatic fluorocarbon or fluorochlorocarbon compound are dissolved in an appropriate solvent, the pigment is dispersed in the resulting solution, and the resulting starting dispersion is sprayed in a dry atmosphere to form developer particles.

Still in addition, developer particles can be prepared by dispersing the above-mentioned starting dispersion into a non-solvent for the binder to form particles and drying the resulting particles according to need.

As the solvent for dissolving the binder and the aliphatic fluorocarbon or fluorochlorocarbon compound, there are preferably employed aromatic solvents such as benzene, toluene, xylene, tetrahydronaphthalene and ethylbenzene, and toluene is especially preferred among them. In addition, there can be used alicyclic hydrocarbon solvents such as cyclohexane, cyclic ethers such as tetrahydrofuran, alcohols such as methanol, esters such as amyl acetate, cellosolves such as butyl cellosolve and ketones such as acetone and methylethyl ketones, so far as they are capable of dissolving the binder therein. A mixture of two or more of solvents can be used, though use of such mixed solvent is ordinarily unnecessary.

It is preferred that such organic solvent be used in an amount of 1 to 50% by weight based on the binder, and that the amount of the solvent be adjusted within this range so that the solid content of the starting dispersion in which the pigment has been incorporated is in the range of from 2 to 50% by weight. Then, the so formed starting dispersion is spray-dried, the dispersion is maintained at a temperature of 5° to 100° C. and it is sprayed into a gas such as air, nitrogen, carbon dioxide gas or combustion gas heated at a temperature of 50° to 150° C. through such a mechanism as a one-fluid nozzle a two-fluid nozzle, a centrifugal spray nozzle or a rotary disc, whereby particles or granules are formed.

When developer particles are formed by wet granulation in a non-solvent, the starting dispersion is prepared by using a dispersion medium formed by combining a water-miscible organic solvent (A) with a water-immiscible organic solvent (B) at an (A)/(B) mixing weight ratio of from 10/1 to 1/10 as taught in Japanese patent application Laid-Open Specification No. 88227/76, and the so formed starting dispersion is poured into water under high shearing agitation to form particles.

In short, the developer of the present invention can be prepared according to an optional process, so far as the above-mentioned components are included into the developer.

DEVELOPER

In the present invention, it is preferred that the number average particle size of the developer be in the range of from 2 to 80μ, especially from 5 to 5μ, though the preferred range of the particle size varies to some extent depending on the preparation process or the intended use. Moreover, it is preferred that the particle size distribution of the developer be such that particles having a size larger than 50μ occupy less than 20% of the total particles and particles having a size smaller than 5μ occupy less than 15% of the total particles.

It is preferred that the shape of the developer particles be substantially spherical. However, since the developer of the present invention contains the aliphatic fluorocarbon or fluorochlorocarbon compound, even if the developer particles have an amorphous shape such as a shape resembling that of sand particles, pulverized particles or granules or they are angular particles, an excellent flowability and a high blocking resistance (reduced tendency to agglomerate) can be maintained in the developer of the present invention. This is another advantage of the developer of the present invention.

The developer of the present invention may be subjected to various post treatments according to the intended use thereof. For example, when the developer of the present invention is used as a one-component type developer, namely an electrically conductive magnetic developer, a necessary electric conductivity can be imparted to the developer by causing electrically conductive fine particles (B) to adhere to the surfaces of particles (A) containing a magnetic pigment (magnetosensitive fixing particles). As the electrically conductive fine particles (B), various carbon blacks such as furnace black and channel black are preferred, and Colax L (electrically conductive carbon black manufactured by Degussa Co.) and Vulcan XC-72R (electrically conductive carbon black manufactured by Cabot Corp.) are especially preferred. In addition, there can be used inorganic fine particles treated with an electric conducting agent or metal powders as the electrically conductive fine particles (B). These electrically conductive fine particles (B) may be physically adsorbed and retained on the surfaces of the particles (A) by dry blending or they may be positively embedded in the surfaces of the particles (A) by fusion bonding or the like. It is preferred that the electrically conductive fine particles (B) be used in an amount of 0.01 to 5% by weight, especially 0.1 to 2% by weight, based on the particles (A).

The developer of the present invention can be used broadly for developing electrostatic images in the electrostatic photographic copying process, the electrostatic printing process, the electrostatic recording process and the like.

Development of electrostatic latent images can be accomplished according to known developing methods, especially the magnetic brush method. As will readily be understood from the fact that the angle of repose of the developer of the present invention in the range of 10° to 70°, especially 30° to 60°, the developer of the present invention has a very excellent flowability. Further, as is seen from the fact that the cohesion ratio (Rc), represented by the following formula, of the developer of the present invention is lower than 10%, especially lower than 5%, the tendency of agglomeration of cohesion of the developer particles is remarkably reduced:

$$Rc=(X/Xo)\times 100$$

wherein Xo stands for the weight (g) of the developer particles which pass through a 200-mesh sieve, and X stands for the weight (g) of the developer particles left on the 200-mesh sieve after the developer particles which have passed through the 200-mesh sieve are heated at 50° C. for 60 minutes.

By virtue of the above-mentioned characteristic properties of the developer of the present invention, when the developer of the present invention is employed, such troubles as contamination of the background by fall-down of the developer particles and blurring of an image by uneven adhesion of the developer particles can be effectively prevented. Furthermore, cohesion or agglomeration of the developer particles by rise of the temperature in a developer storing zone of the developing apparatus can be effectively prevented.

Since the amount incorporated of the aliphatic fluorocarbon or fluorochlorocarbon compound as the offset-preventing agent is very small in the developer of the present invention, when the developer of the present invention is used, there can be attained a prominent advantage that contamination of the magnetic carrier or the electrostatic photographic photosensitive plate (master) can be effectively prevented. In known offset-preventing toners including a relatively large quantity of a parting substance or lubricant, such offset-preventing substance adheres to the magnetic carrier and is gradually accumulated thereon to cause degradation of the magnetic carrier. Further, in the copying or printing process of the type where toner particles or developer particles are transferred to a transfer sheet from a photosensitive plate and the photosensitive plate is used repeatedly, such offset-preventing substance adheres to the photosensitive plate and is gradually accumulated thereon to cause the above-mentioned various disadvantages. In contrast, in case of the developer of the present invention, the tendency of the aliphatic fluorocarbon or fluorochlorocarbon compound to shift and adhere to the carrier or photosensitive plate is remarkably diminished, and the life of the carrier or photosensitive plate can be prominently prolonged.

Further, when the parting substance heretofore incorporated in toners is used in an amount sufficient to attain a substantial offset-preventing effect, bad influences are often imposed on charge properties of the toner particles, such as the charge polarity and charge quantity, causing so-called fogging or resulting in reduction of the image density (see Comparative Example given hereinafter). In case of the developer of the present invention, since the specific aliphatic fluorocarbon or fluorochlorocarbon compound is used as the offset-preventing agent, no bad influences are imposed on the charge characteristics of the developer particles.

An image of the developer particles formed by the development is fixed under application of pressure or heat as it is or after it has been transferred onto a transfer sheet. A pair of pressing metal rolls can be used for pressure fixation, and a polytetrafluoroethylene-coated roller having a heating mechanism installed in the interior thereof can be used for heat fixation. In each case, occurrence of the phenomenon that the developer of the present invention is transferred to the roll surface, namely the offset phenomenon, can be prevented completely. In general, heat fixation may be carried out at temperatures within a relatively broad range of 140° to 200° C. and pressure fixation can be accomplished under a roller pressure of 200 to 500 Kg/cm$^2$, though these temperature and pressure conditions vary to some extent depending on the kind of the binder contained in the developer.

Excellent effects attained by the present invention will now be described in detail by reference to the following Examples that by no means limit the scope of the invention.

COMPARATIVE EXAMPLE

In this Example, it is illustrated that the developer of the present invention comprising particle pigments, a binder and an aliphatic fluorocarbon or fluorochlorocarbon compound is much excellent over a developer containing a known parting agent with respect to the photocopying and developing characteristics.

1. Developer Compositions Used at Comparative Tests:

(a) Developer Composition of Present Invention:

| | |
|---|---|
| Styrene resin (Piccolastic D-150 manufactured by Esso Petrochemical) | 50 parts by weight |
| Styrene/acrylate copolymer (Pliolite AC manufactured by Goodyear) | 30 parts by weight |
| Nigrosine Base EX (manufactured by Orient Chemical) | 1.6 parts by weight |
| Carbon black (Carbon #30 manufactured by Mitsubishi Kasei) | 5 parts by weight |
| Fluorine type surface active agent (Megafac F-184 manufactured by Dainippon Ink) | 0.4 part by weight |

(b) Developer Composition Including Known Parting Agent:

The developer composition was prepared by using the same components as in the developer composition of the present invention except that 12 parts by weight of low-molecular-weight polypropylene (Viscol 550P manufactured by Sanyo Kasei) was used instead of 0.4 part by weight of the fluorine type surface active agent.

(c) Developer Composition Free of Parting Agent:

The developer composition was prepared by using the same components as in the developer composition of the present invention except that 0.4 part by weight of the fluorine type surface active agent was not incorporated.

The components of each composition were mixed, and the mixture was fused and kneaded at 150±5° C. for about 2 hours in a mill including three hot rolls. The kneaded mixture was cooled to room temperature (10° to 20° C.) to solidify the mixture. Then, the kneaded mixture was roughly pulverized by a feather mill and then finely pulverized by an ultrasonic jet mill pulverizer to obtain a developer having a particle size distribution range of from 5 to 30μ.

The copying and developing characteristics of the so obtained developers were determined according to the measurement methods described below.

2. Measurement Methods:

(A) Resistance to Offsetting to Fixing Roller:

50 g of a sample developer was homogeneously mixed with 950 g of an iron powder carrier (EFV 200–300 manufactured by Nippon Teppun), and the mixture was charged in a developer bottle of an electrostatic copying machine (installed with a heat-fixing roller coated with a tetrafluoroethylene resin) manufactured by Mita Industrial Co. An original having an image was reproduced at a fixing temperature of 180±3° C., and the contamination of the fixing roller and the offset state of the copied image were examined with the naked eye.

(B) Flowability (Angle of Repose) of Developer:

A sample developer was packed in a cylindrical glass vessel (having a capacity of 600 ml) and the free surface was levelled horizontally. The packed vessel was inclined, and the inclination angle at which the developer particles present in the surface portion began to slip was measured by a protractor.

(C) Cohesiveness:

30 g of a sample developer was precisely weighed and classified by a 200-mesh sieve. The weight of the developer particles passing through the 200-mesh sieve was precisely measured, and these particles were charged in a broad-mouthed glass vessel and heated and dried for 60 minutes in a drier maintained at 50° C. Then, the particles were classified by the 200-mesh sieve again and the weight of the developer particles left on the 200-mesh sieve was measured to evaluate the cohesiveness.

(D) Adaptability to Continuous Copying Operation (Contamination of Master and Fogging of Print):

50 g of a sample developer was homogeneously mixed with 950 g of an iron powder carrier (EFV 200–300 manufactured by Nippon Teppun), and the mixture was charged in a developer bottle of an electrostatic copying machine Model 251 manufactured by Mita Industrial Co. (installed with a heat-fixing roller coated with a tetrafluoroethylene resin). The continuous copying operation was carried out at a fixing temperature of 180±3° C. by using an original having an image. Every time a prescribed number of prints were obtained, the operation was temporarily stopped, the contamination of the master, the fogging state in the obtained prints and the developer supply state were examined with the naked eye.

Incidentally, an appropriate amount of the developer was charged in a supply vat and the developer was continuously supplied therefrom.

Obtained results are shown in Table 1.

TABLE 1

| Test Items | Developer (a) of Present Invention | Comparative Developer (b) | Comparative Developer (c) |
|---|---|---|---|
| Offset Resistance | good | good | bad |
| Flowability | 50° | 70° | 85° |
| Cohesiveness | | | |
| untreated particle sieve residue (% by weight) | 8.3 | 16.7 | 53.3 |
| cohesion ratio (Rc) | 4.7% | 15.0% | 48.0% |
| Adaptability to Continuous Operation | | | |
| contamination of master | | | |
| 50th print | good | good | bad |
| 100th print | good | good | bad |
| 200th print | good | bad | bad |
| 500th print | good | bad | bad |
| fogging state | | | |
| 50th print | good | good | fogging caused even in first print |
| 100th print | good | bad | |
| 200th print | good | bad | |
| 500th print | good | bad | |
| developer supply state | | | |
| 100th print | good | bad | bad |
| 200th print | good | bad | bad |
| 500th print | good | bad | bad |

As will readily be understood from the results shown in Table 1, the developer of the present invention is remarkably excellent over the comparative developers with respect to the offset resistance, the flowability, the cohesiveness and the adaptability to the continuous operation.

EXAMPLE 1

Two-component type developer composition:

| | |
|---|---|
| Styrene resin (Piccolastic D-150 manufactured by Esso Petrochemical) | 52 parts by weight |
| Styrene/acrylate copolymer (Pliolite AC manufactured by Goodyear) | 28 parts by weight |
| Oil-soluble dye (Nigrosine Base EX manufactured by Orient Chemical) | 1.6 parts by weight |
| Carbon black (Carbon #30 manufactured by Mitsubishi Kasei) | 4.8 parts by weight |
| Fluorine type surface active agent (Megafac F-184 manufactured by Dainippon Ink) | 0.24 part by weight |

A mixture comprising the above components was fused and homogeneously kneaded at 150±5° C. for about 2 hours in a hot roll mill, and the mixture was cooled to room temperature (10° to 20° C.) to solidify the mixture. Then, the solidified mixture was finely pulverized by an ultrasonic jet mill pulverizer to obtain a toner having an average particle size of about 5 to about 30μ. The copying operation was carried out by using the so obtained toner in a copying machine Electronic Copystar Model 251R manufactured by Mita Industrial Co. (installed with a heat-fixing roller coated with Teflon). No contamination was observed on the surface of the heat-fixing roller and clear images free of the offset phenomenon were obtained. Even if the foregoing operation was repeated to obtain 1000 prints, no contamination was observed on the surface of the fixing roller and clear prints free of the offset phenomenon were obtained.

EXAMPLE 2

Two-component type developer composition:

| | |
|---|---|
| Styrene/acrylate copolymer (Pliolite AC manufactured by Goodyear) | 20 parts by weight |
| Styrene-butadiene copolymer (Nipol 2007 J manufactured by Japanese Geon) | 60 parts by weight |
| Oil-soluble dye (Sumisol Black AR manufactured by Sumitomo Chemical) | 1.6 parts by weight |
| Carbon black (Leaven 40 manufactured by Columbia Carbon) | 5.6 parts by weight |
| Fluorine type surface active agent (Megafac F-173 manufactured by Dainippon Ink) | 0.16 parts by weight |

A mixture comprising the above components was treated and the copying operation was carried out in the same manner as described in Example 1, and the contamination of the fixing roller with the toner and occurrence of the offset phenomenon were examined. Obtained results were the same as those obtained in Example 1.

EXAMPLE 3

Two-component type developer composition:

| | |
|---|---|
| Styrene-butyl methacrylate copolymer (Paraloid B-66 manufactured by Rohm & Haas) | 65 parts by weight |
| Saturated polyester resin (Ester Resin 20 manufactured by Toyobo) | 35 parts by weight |
| Oil-soluble dye (Oil Black HBB manufactured by Orient Chemical) | 1.5 parts by weight |
| Oil-soluble dye (Spilon Black GMH Special manufactured by Hodogaya Chemical) | 1.0 part by weight |
| Carbon black (Diablack SH manufactured by Mitsubishi Kasei) | 6.5 parts by weight |
| Fluorine type surface active agent (Megafac F-528 manufactured by Dainippon Ink) | 0.5 part by weight |

A mixture comprising the above components was treated and the copying operation was carried out in the same manner as in Example 1. The contamination of the fixing roller with the toner and occurrence of the offset phenomenon were examined. Obtained results were the same as those obtained in Example 1.

EXAMPLE 4

Two-component type developer composition:

| | |
|---|---|
| Styrene resin (Dicelastyrene #200 manufactured by Dicelastyrene Co.) | 135 parts by weight |
| Rosin-modified maleic acid resin (Teskid MRG-H manufactured by Tokushima Seiyu) | 15 parts by weight |
| Oil-soluble dye (Nigrosine Base EX manufactured by Orient Chemical) | 2.25 parts by weight |
| Carbon black (MA-100 manufactured by Mitsubishi Kasei) | 10.2 parts by weight |
| Fluorine type surface active | 0.45 part by weight |

-continued

| | |
|---|---|
| agent (Megafac F-183 manufactured by Dainippon Ink) | |

A mixture comprising the above components was fused and kneaded at 160±2° C. for about 3 hours by a heating kneader to form a homogeneous dispersion. The dispersion was cooled to room temperature (10° to 20° C.) to solidify the dispersion. The resulting solid was finely pulverized by a jet mill pulverizer to obtain a toner having an average particle size of about 5 to about 30 microns. By using the so obtained toner, the copying operation was carried out in a copying machine Electronic Copystar Model 251R manufactured by Mita Industrial Co. (installed with a Teflon-coated roller for heat fixation). No contamination of the roller surface with the toner was observed, and clear copies free of the offset phenomenon were obtained. Even if the foregoing operation was continuously repeated to obtain 1000 prints, no contamination was observed on the fixing roller, and clear prints free of the offset phenomenon were obtained.

EXAMPLE 5

Two-component type developer composition:

| | |
|---|---|
| Styrene/acrylate copolymer (Kanebilac L-XMK manufactured by Kanegafuchi Chemical) | 96 parts by weight |
| Epoxy resin (Epikote 1007 manufactured by Shell Chemical) | 24 parts by weight |
| Oil-soluble dye (Oil Black BW manufactured by Orient Chemical) | 2.16 parts by weight |
| Carbon black (Carbon #30 manufactured by Mitsubishi Kasei) | 7.8 parts by weight |
| Fluorine type surface active agent (Megafac F-141 manufactured by Dainippon Ink) | 0.36 part by weight |

A mixture comprising the above components was treated and the copying operation was carried out in the same manner as described in Example 4. The contamination of the fixing roller with the toner and occurrence of the offset phenomenon were examined. Obtained results were the same as those obtained in Example 4.

EXAMPLE 6

Two-component type developer composition:

| | |
|---|---|
| Carbon black (Special Black IV manufactured by Degussa Co.) | 14 parts by weight |
| Styrene resin (Piccolastic D150 manufactured by Esso Chemical) | 50 parts by weight |
| Styrene-butadiene copolymer (Nipol 2057S manufactured by Japanese Geon) | 20 parts by weight |
| Oil-soluble dye (Oil Black HBB manufactured by Orient Chemical) | 1.4 parts by weight |
| Fluorine type surface active agent (Megafac F-172 manufactured by Dainippon Ink) | 0.21 part by weight |
| Toluene | 215 parts by weight |

A mixture comprising the above components was agitated for 1.0 hour by an attritor to form a homogeneous dispersion. The dispersion was spray-dried by a spray drier (hot air temperature being 150° C.) to obtain a toner having an average particle size of about 5 to about 30 microns. By using the so formed toner, the copying operation was carried out in a copying machine Electronic Copystar 251R manufactured by Mita Industrial Co. No contamination of the heat fixing roller was observed and clear copies free of the offset phenomenon were obtained. Even if the foregoing operation was continuously repeated to obtain 1000 prints, obtained results were the same as above.

EXAMPLE 7

Two-component type developer composition:

| | |
|---|---|
| Vinyl toluene-butadiene copolymer (Piolite VT manufactured by Goodyear) | 80 parts by weight |
| Epoxy resin (Epiclon 4050 manufactured by Dainippon Ink) | 15 parts by weight |
| Oil-soluble dye (Oil Black BW manufactured by Orient Chemical) | 1.5 parts by weight |
| Carbon black (Diablack SH manufactured by Mitsubishi Kasei) | 19 parts by weight |
| Fluorine type surface active agent (Megafac F-130 manufactured by Dainippon Ink) | 0.38 part by weight |
| Methylethyl ketone | 130 parts by weight |
| Toluene | 260 parts by weight |

A mixture comprising the above components was treated and the copying operation was carried out in the same manner as described in Example 6. The contamination of the fixing roller with the toner and occurrence of the offset phenomenon were examined. Obtained results were the same as those obtained in Example 6.

EXAMPLE 8

Two-component type developer composition:

| | |
|---|---|
| α-Methylstyrene/vinyl toluene copolymer (Piccotex 120 manufactured by Esso Chemical) | 25 parts by weight |
| Styrene-butadiene copolymer (Pliolite S-5B manufactured by Goodyear) | 75 parts by weight |
| Oil-soluble dye (Nigrosine Base EX manufactured by Orient Chemical) | 2.5 parts by weight |
| Carbon black (Special Black IV manufactured by Degussa Co.) | 25 parts by weight |
| Fluorine type surface active agent (Megafac F-113 manufactured by Dainippon Ink) | 0.5 part by weight |
| Toluene | 512 parts by weight |

A mixture comprising the above components was stirred for 24 hours by a ball mill to form a homogeneous dispersion. The resulting dispersion was spray-dried by a spray drier (hot air temperature being 150° C.) to obtain a toner having an average particle size of about 5 to about 30 microns. An electrostatic image obtained according to the customary electrophotographic process was developed with the so obtained toner, and the toner image was transferred onto a transfer sheet and the transferred toner image was fixed by a pressure fixing roller. No contamination of the fixing roller with the toner was observed and clear images free of the offset phenomenon were obtained.

EXAMPLE 9

Two-component type developer composition:

| | |
|---|---|
| Styrene resin (Piccolastic D125 manufactured by Esso Chemical) | 250 parts by weight |
| Vinyl toluene/acrylate copolymer (Pliolite VTAC-L manufactured by Goodyear) | 140 parts by weight |
| Alkyl-modified phenolic resin (PP-5121 manufactured by Gunei Chemical) | 10 parts by weight |
| Oil-soluble dye (Spilon Black GMH Special manufactured by Hodogaya Chemical) | 10 parts by weight |
| Fluorine type surface active agent (Megafac F-143 manufactured by Dainippon Ink) | 1.4 parts by weight |
| Carbon black (Special Black IV manufactured by Degussa Co.) | 120 parts by weight |
| Toluene | 1770 parts by weight |

A mixture comprising the above components was treated and the copying operation was carried out in the same manner as described in Example 8. The contamination of the fixing roller with the toner and occurrence of the offset phenomenon were examined. Obtained results were the same as those obtained in Example 8.

EXAMPLE 10

Two-component type developer composition:

| | |
|---|---|
| Styrene/acrylate copolymer (Paraid B-72 manufactured by Rohm & Haas) | 65 parts by weight |
| Polyisobutylene resin (Vistanex MML-80 manufactured by Petrochemical Co.) | 60 parts by weight |
| Oil-soluble dye (Nigrosine Base EX manufactured by Orient Chemical) | 1.85 parts by weight |
| Carbon black (Special Black IV manufactured by Degussa Co.) | 9.4 parts by weight |
| Fluorine type surface active agent (Megafac F-109 manufactured by Dainippon Ink) | 0.4 part by weight |

A mixture comprising the above components was fused and kneaded at 150±5° C. for about 2 hours in a hot roll mill and the kneaded mixture was cooled to room temperature (10° to 20° C.) to solidify the mixture. Then, the mixture was pulverized by a jet mill pulverizer to obtain a toner having an average particle size of 5 to 30 microns. An electrostatic image was formed according to the customary electrophotographic process, and the electrostatic image was developed by the so formed toner. The toner image was then transferred onto a transfer sheet, and the toner image was fixed by a pressure fixing roller. No contamination of the fixing roller with the toner was observed, and clear images free of the offset phenomenon were obtained.

EXAMPLE 11

Two-component type developer composition:

| | |
|---|---|
| Styrene resin (Piccolastic D-125 manufactured by Esso Chemical) | 110 parts by weight |
| Styrene resin (Amokoresin 18-240 manufactured by Amoco) | 90 parts by weight |
| Oil-soluble dye (Smisol Black AR manufactured by Sumitomo Chemical) | 5 parts by weight |
| Carbon black (Carbon #30 manufactured by Mitsubishi Kasei) | 20 parts by weight |
| Fluorine type surface active agent (Megafac F-141 manufactured by Dainippon Ink) | 1.0 part by weight |

A mixture comprising the above components was treated and the copying operation was carried out in the same manner as described in Example 10. The contamination of the fixing roller with the toner and occurrence of the offset phenomenon were examined. Obtained results were the same as those obtained in Example 10.

EXAMPLE 12

Two-component type developer composition:

| | |
|---|---|
| Vinyl toluene/butadiene copolymer (Pliolite VT-L manufactured by Goodyear) | 126 parts by weight |
| Styrene-indene-isoprene copolymer (Veicicol X manufactured by Veicicol) | 54 parts by weight |
| Oil-soluble dye (Nigrosine Base EX manufactured by Orient Chemical) | 3.6 parts by weight |
| Carbon black (Leaven 40 manufactured by Columbia Carbon) | 14.4 parts by weight |
| Fluorine type surface active agent (Megafac F-170 manufactured by Dainippon Ink) | 0.63 part by weight |

A mixture comprising the above components was fused and kneaded at 150±5° C. for about 3 hours by a heating kneader to form a homogeneous dispersion. The dispersion was cooled to room temperature (10° to 20° C.) to solidify the dispersion. The solid was pulverized by a jet mill pulverizer to obtain a toner having an average particle size of about 5 to about 30 microns. An electrostatic image formed by the customary electrophotographic process was developed with the so formed toner, and the toner image was transferred onto a transfer sheet and fixed by a pressure fixing roller. No contamination of the fixing roller with the toner was observed and clear images free of the offset phenomenon were obtained.

EXAMPLE 13

One-component type developer composition:

| | |
|---|---|
| Styrene-acrylate copolymer (Pliolite ACL manufactured by Goodyear) | 100 parts by weight |
| Fluorine type surface active agent (Megafac F-172 manufactured by Dainippon Ink) | 0.3 part by weight |
| Triiron tetroxide (Mapico BL-100 manufactured by Titan Kogyo) | 180 parts by weight |
| Carbon black (Special Black IV manufactured by Degussa Co.) | 10 parts by weight |

A mixture comprising the above components was fused and kneaded at 150° C. for about 2 hours by a hot roll mill to form a homogeneous composition. The composition was cooled to room temperature (10° to 20° C.) and pulverized by a pin mill type pulverizer to form toner particles having a size of 5 to 50 microns. By using the so obtained toner particles, the copying operation was carried out in a copying machine Electronic Copystar Model 700D manufactured by Mita Industrial Co. (a Teflon-coated heat fixing roller being installed). No contamination of the fixing roller was observed and clear copies free of the offset phenomenon were obtained. Even if the copying operation was continuously repeated to obtain 1000 prints, no contamination of the fixing roller was observed, and clear prints free of the offset phenomenon were obtained.

EXAMPLE 14

One-component type developer composition:

| | |
|---|---|
| Styrene resin (Piccolastic D-125 manufactured by Esso Chemical) | 70 parts by weight |
| Acrylic resin (Paraloid B-44 manufactured by Rohm & Haas) | 30 parts by weight |
| Fluorine type surface active agent (Megafac F-110 manufactured by Dainippon Ink) | 0.5 part by weight |
| Triiron tetroxide (Tetsuguro B6 manufactured by Toyo Shikiso) | 150 parts by weight |
| Carbon black (Carbon #44 manufactured by Mitsubishi Kasei) | 20 parts by weight |

A mixture comprising the above components was fused and kneaded at 160° C. for about 3 hours by a heating kneader to form a homogeneous composition. The composition was cooled to room temperature (10° to 20° C.) and pulverized by a pin mill type pulverizer to form toner particles having a particle size of 5 to 50 microns. By using the obtained toner particles, the copying operation was carried out in copying machine Electronic Copystar Model 700D manufactured by Mita Industrial Co. No contamination of the heat fixing roller with the toner was observed and clear copies free of the offset phenomenon were obtained. Even if the operation was continuously repeated to obtain 1000 prints, no contamination of the fixing roller was observed and clear prints free of the offset phenomenon were obtained.

EXAMPLE 15

One-component type developer composition:

| | |
|---|---|
| Styrene resin (Piccolastic D-150) | 70 parts by weight |
| Terpene resin (YS Resin PX 1150 manufactured by Yasuhara Yushi) | 30 parts by weight |
| Fluorine type surface active agent (Megafac F-170 manufactured by Dainippon Ink) | 0.7 part by weight |
| Triiron tetroxide (EDT-500 manufactured by Toda Kogyo) | 200 parts by weight |
| Carbon black (Colax B manufactured by Degussa Co.) | 10 parts by weight |
| Toluene | 600 parts by weight |

A mixture comprising the above components was agitated for 30 minutes by an attritor to form a homogeneous solution. The dispersion was spray-dried by a spray drier (hot air temperature being 150° C.) and then classified to obtain toner particles having a particle size of 5 to 30 microns. By using the so formed toner particles, the copying operation was carried out in a copying machine Electronic Copystar Model 700D manufactured by Mita Industrial Co. No contamination of the heat fixing roller with the toner was observed and clear copies free of the offset phenomenon were obtained. Even if the operation was continuously repeated to obtain 1000 prints, no contamination of the fixing roller was observed and clear prints free of the offset phenomenon were obtained.

EXAMPLE 16

One-component type developer composition:

| | |
|---|---|
| Styrene resin (Highmer ST 120 manufactured by Sanyo Kasei) | 60 parts by weight |
| Phenolic resin (PP-5121 manufactured by Gunei Chemical) | 17.5 parts by weight |
| Polyamide resin (Versamid 940 manufactured by Daiichi General) | 12.5 parts by weight |
| Fluorine type surface active agent (Megafac F-171) | 0.8 part by weight |
| Triiron tetroxide (Dowa Black N-805 manufactured by Dowa Teppun) | 170 parts by weight |
| Carbon black (Carbon #30 manufactured by Mitsubishi Kasei) | 12.5 parts by weight |
| Toluene | 470 parts by weight |
| Isobutanol | 230 parts by weight |

Toner particles were prepared from a mixture comprising the above components in the same manner as described in Example 15, and by using the so prepared toner particles, the copying operation was carried out. The contamination of the heat fixing roller and occurrence of the offset phenomenon were examined. Obtained results were the same as those obtained in Example 15.

EXAMPLE 17

One-component developer composition:

| | |
|---|---|
| Styrene resin (Piccolastic D-100) | 48 parts by weight |
| Epoxy resin (Epikote 1004 manufactured by Shell Chemical) | 22 parts by weight |
| Polyester resin (Vylon 300 manufactured by Toyobo) | 15 parts by weight |
| Fluorine type surface active agent (Megafac F-144) | 1.2 parts by weight |
| Triiron tetroxide (Mapico BL-500 manufactured by Titan Kogyo) | 150 parts by weight |
| Carbon black (Carbon #44 manufactured by Mitsubishi Kasei) | 8 parts by weight |
| Methylethyl ketone | 360 parts by weight |
| Toluene | 280 parts by weight |

In the same manner as described in Example 15, toner particles were prepared from a mixture comprising the above components. An electrostatic image formed according to the customary electrophotographic process was developed with the so prepared toner particles, and the toner particle was transferred onto a transfer sheet and fixed by heating and fusion of the toner particles by using a heat fixing roller coated with Teflon. No contamination of the fixing roller was observed, and clear copied images free of the offset phenomenon were obtained.

EXAMPLE 18

One-component type developer composition:

| | |
|---|---|
| Styrene resin (Amokoresin 18-240 manufactured by Amoco) | 85 parts by weight |
| Polyvinyl butyral resin (Slec BL-1 manufactured by Sekisui Chemical) | 15 parts by weight |
| Fluorine type surface active agent (Megafac F-183) | 0.2 part by weight |
| Triiron tetroxide (EPT-700 manufactured by Toda Kogyo) | 220 parts by weight |
| Oil-soluble dye (Oil Black HBB manufactured by Orient Chemical) | 5 parts by weight |
| Toluene | 680 parts by weight |

A mixture comprising the above components was treated in the same manner as described in Example 15 to obtain toner particles. By using the so prepared toner particles, the copying operation was carried out in a copying machine Electronic Copystar Model 900 D (installed with a pressure fixing roller). No contamination of the fixing roller was observed and clear copies free of the offset phenomenon were obtained. Even if the operation was continuously repeated to obtain 1000 prints, no contamination of the fixing roller was observed and clear prints free of the offset phenomenon were obtained.

EXAMPLE 19

One-component type developer composition:

| | |
|---|---|
| Acrylic resin (Paraloid B-67 manufactured by Rohm & Haas) | 43 parts by weight |
| Styrene resin (Escorez 5310 manufactured by Esso Chemical) | 38 parts by weight |
| Terpene-phenol copolymer (YS Polyester manufactured by Yasuhara Yushi) | 19 parts by weight |
| Fluorine type surface active agent (Megafac F-184) | 0.1 parts by weight |
| Triiron tetroxide (Tetsuguro B6) | 185 parts by weight |
| Carbon black (Special Black IV) | 16 parts by weight |
| Toluene | 700 parts by weight |

A mixture comprising the above components was treated in the same manner as described in Example 15 to form toner particles. The contamination of the fixing roller with the toner and occurrence of the offset phenomenon were examined. Obtained results were the same as those obtained in Example 18.

EXAMPLE 20

One-component type developer composition:

| | |
|---|---|
| Styrene-olefin copolymer (Klyrvel 90 manufactured by Velsicol Chemical) | 47 parts by weight |
| Styrene/acrylate copolymer (Pliolite AC manufactured by Goodyear) | 33 parts by weight |
| Fluorine type surface active agent (Megafac F-143) | 0.4 part by weight |
| Finely divided aluminum | 15 parts by weight |
| Triiron tetroxide (Mapico BL-100 manufactured by Titan Kogyo) | 140 parts by weight |
| Carbon black (Colax L manufactured by Degussa Co.) | 8 parts by weight |
| Toluene | 650 parts by weight |

A mixture comprising the above components was treated in the same manner as described in Example 15 to form toner particles. The contamination of the pressure fixing roller and occurrence of the offset phenomenon were examined. Obtained results were the same as those obtained in Example 18.

EXAMPLE 21

One-component type developer composition:

| | |
|---|---|
| Rosin-modified maleic acid resin (Teskid MRG-H manufactured by Tokushima Yushi) | 38 parts by weight |
| Styrene resin (Highmer ST90) | 62 parts by weight |
| Fluorine type surface active agent (Megafac F-113) | 0.3 part by weight |
| Triiron tetroxide (EPT-500 manufactured by Toda Kogyo) | 190 parts by weight |
| Carbon Black (Denka Black manufactured by Denki Kagaku) | 10 parts by weight |
| Oil-soluble dye (Spilon Black GMH manufactured by Hodogaya Chemical | 5 parts by weight |

A mixture comprising the above components was treated in the same manner as described in Example 13 to form toner particles. The contamination of the pressure fixing roller with the toner and occurrence of the offset phenomenon were examined. Obtained results were the same as those obtained in Example 18.

EXAMPLE 22

One-component type developer composition:

| | |
|---|---|
| Styrene-acrylate resin (Kanebilac L-FX manufactured by Kanegafuchi Chemical) | 60 parts by weight |
| Polysiobutyrene (Vistanex MML-80 manufactured by Petrochemical) | 30 parts by weight |
| Phenolic resin (Tamanol 1110R manufactured by Arakawa Rinsan) | 10 parts by weight |
| Fluorine type surface acitve agent (Megafac F-120) | 0.2 part by weight |
| Triiron tetroxide (Tetsuguro B6) | 180 parts by weight |
| Carbon black (Denka Black) | 20 parts by weight |

A mixture comprising the above components was treated in the same manner as described in Example 14 to form toner particles. An electrostatic image formed according to customary electrophotographic process was developed with the so prepared toner particles, and the toner image was transferred onto a transfer sheet and fixed by using a pressure fixing roller. No contamination of the fixing roller with the toner was observed, and clear copied images free of the offset phenomenon were obtained.

EXAMPLE 23

One-component type developer composition:

| | |
|---|---|
| Styrene-butyl methacrylate copolymer (SMB-7300 manufactured by Sanyo Kasei) | 50 parts by weight |
| Epoxy resin (Epikote 1002 manufactured by Shell Chemical) | 25 parts by weight |

-continued

| | |
|---|---|
| Low polymer of ethylene trifluoride monochloride (Daifuroil #10 manufactured by Daikin Kogyo) | 1.5 parts by weight |
| Triiron tetroxide (Tetsuguro B6 manufactured by Toyo Shikiso) | 150 parts by weight |
| Carbon black (Vulcan XC-72 manufactured by Cabot) | 10 parts by weight |

A mixture comprising the above components was treated in the same manner as described in Example 13 to obtain toner particles. When toner images were passed through heat fixing rollers, clear images free of the offset phenomenon were obtained.

EXAMPLE 24

Two-component type developer composition:

| | |
|---|---|
| Styrene/acrylate copolymer (Plaolite AC manufactured by Goodyear) | 20 parts by weight |
| Styrene/butadiene copolymer (Plaolite S-5B manufactured by Goodyear) | 60 parts by weight |
| Oil-soluble dye (Sumisol Black AR manufactured by Sumitomo Chemical) | 16 parts by weight |
| Carbon black (Leaven 40 manufactured by Columbia Carbon) | 5.6 parts by weight |
| Fluorine type wax (Polyflon Wax manufactured by Daikin Kogyo) | 1.0 part by weight |

A mixture comprising the above components was treated and the copying operation was carried out in the same manner as described in Example 1. The contamination of the fixing roller with the toner and occurrence of the offset phenomenon were examined. Obtained results were the same as those obtained in Example 1.

What we claim is:

1. A process for developing and fixing an electrostatic image comprising developing the electrostatic image by contacting the electrostatic image with a developer consisting essentially of particles comprising a pigment, a binder and an offset-preventing agent selected from the group consisting of aliphatic fluorocarbon compounds and fluorochlorocarbon compounds to allow the developer to adhere to said electrostatic image, transferring the image formed by said developer to a transfer sheet, and fixing the transferred developer image onto said transfer sheet by contacting the transfer sheet while carrying said developer image with a heated polytetrafluoroethylene surface.

2. The process of claim 1 wherein the temperature of the polytetrafluoroethylene surface is in the range of about 140° to 200° C.

3. The process of claim 1 wherein the offset-preventing agent is present in an amount of 0.01 to 15% by weight based on the binder.

4. The process of claim 1 wherein the offset-preventing agent is present in an amount of 0.1 to 5% by weight based on the binder.

5. The process of claim 1 wherein the offset-preventing agent is a substantially nonvolatile liquid or solid substance having a fluoroalkyl or fluorochloroalkyl group having at least 4 carbon atoms.

6. The process of claim 5 wherein said substance has a molecular weight of at least 400.

7. The process of claim 19 wherein the offset-preventing agent is a surface active agent having a long-chain fluoroalkyl group.

8. The process of claim 1 wherein the offset-preventing agent is a nonionic surface active agent having a long-chain fluoroalkyl group and polyalkylene oxide units.

9. The process of claim 8 wherein the offset-preventing agent is a compound represented by the following formula:

$$C_nF_{2n+1}SO_2-\overset{\overset{\displaystyle R}{|}}{N}(R_2O)_m-H$$

wherein R stands for a hydrogen atom or a lower alkyl group having up to 4 carbon atoms, n is a number of at least 5, $R_2$ stands for an alkylene group having 2 to 3 carbon atoms, and m is a number of at least 2.

10. The process of claim 1 wherein the offset-preventing agent is a compound represented by the following formula:

$$C_nF_{2n+1}-A-R_2O)_mR_5$$

or $$C_nF_{2n+1}-A-(R_2O)_{m-1}R_2-A-C_nF_{2n+1}$$

wherein n is a number of at least 5, m is a number of at least 2, $R_2$ stands for an alkylene group having 2 to 3 carbon atoms, $R_5$ stands for a lower alkyl group having up to 4 carbon atoms, and A stands for a group $$-\underset{\underset{\displaystyle O}{\|}}{OCNH}-Y-\underset{\underset{\displaystyle O}{\|}}{NHCO}- \text{ or } \underset{\underset{\displaystyle O}{\|}}{OC}-Y-\underset{\underset{\displaystyle O}{\|}}{CO}-$$

in which Y stands for a divalent aliphatic or aromatic hydrocarbon group.

11. The process of claim 1 wherein the offset-preventing agent is an acrylic copolymer comprising a monomer represented by the following formula:

$$CH_2=\overset{\overset{\displaystyle R}{|}}{\underset{\underset{\displaystyle COOC_nF_{2n+1}}{|}}{C}}$$

wherein R stands for a hydrogen atom or a lower alkyl group having up to 4 carbon atoms, and a monomer represented by the following formula:

$$CH_2=\overset{\overset{\displaystyle R}{|}}{\underset{\underset{\displaystyle COO(R_2O)_m-R_5}{|}}{C}}$$

wherein R is as defined above, $R_2$ stands for an alkylene group having 2 to 3 carbon atoms, $R_5$ stands for a lower alkyl group having up to 4 carbon atoms, and m is a number of at least 2.

12. The process of claim 1 wherein the offset-preventing agent is a low-molecular-weight polymer of at least one member selected from the group consisting of ethylene tetrafluoride, propylene hexafluoride and ethylene trifluoride monochloride, said polymer having a number average molecular weight of 400 to 2000.

13. The process of claim 1 wherein the binder is a resin, wax or rubber showing an adhesiveness under application of heat or pressure.

14. The process of claim 1 wherein the binder is a homopolymer of a monomer represented by the following formula:

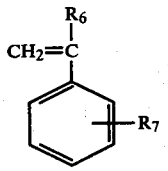

wherein $R_6$ stands for a hydrogen atom or a lower alkyl group having up to 4 carbon atoms and $R_7$ stands for a hydrogen atom or a lower alkyl group having up to 4 carbon atoms, a copolymer of monomers represented by the above formula or a copolymer of a monomer represented by the above formula with other ethylenically unsaturated monomer.

15. The process of claim 1 wherein the binder is an acrylic resin.

16. The process of claim 1 wherein the pigment is present in an amount of 1 to 300% by weight based on the binder.

17. The process of claim 1 wherein the developer is a one-component type developer consisting essentially of particles comprising (a) a binder selected from the group consisting of homopolymers of a vinyl aromatic hydrocarbon, copolymers of vinyl aromatic hydrocarbons and copolymers of a vinyl aromatic hydrocarbon with other ethylenically unsaturated monomer, (b) 0.1 to 5% by weight, based on the binder, of a nonionic surface active agent having a long-chain fluoroalkyl group and polyalkylene oxide units, (c) 50 to 300% by weight, based on the binder, of a pigment composed of a fine powder of a magnetic material, and (d) 1 to 15% by weight, based on the binder, of carbon black.

18. The process of claim 17 wherein said particles comprise 0.1 to 2% by weight, based on said particles, of electrically conductive carbon black sprinkled on the surfaces of said particles by dry blending.

19. The process of claim 1 wherein the developer is a two-component type developer consisting essentially of particles comprising (a) a binder selected from the group consisting of homopolymers of a vinyl aromatic hydrocarbon, copolymers of vinyl aromatic hydrocarbons and copolymers of a vinyl aromatic hydrocarbon with other ethylenically unsaturated monomer, (b) 0.1 to 5% by weight, based on the binder, of a nonionic surface active agent having a long-chain fluoroalkyl group and polyethylene oxide units, (c) 2 to 10% by weight, based on the binder, of at least one coloring agent selected from the group consisting of coloring pigments and dyes, and (d) 0.1 to 5% by weight, based on the binder, of a charge controlling agent.

20. In a process for developing and fixing an electrostatic image which has been formed on a photosensitive sheet by contacting the electrostatic image with a powdery developer containing pigment and binder to develop the electrostatic image and contacting the developed image directly on the photosensitive sheet or after transfer to a transfer sheet with a heated roller to fix the developed image, the improvement comprising incorporating in the powdery developer an offset-preventing agent comprising a nonionic surface active agent having a long-chain fluoroalkyl group and polyalkylene oxide units and being present in an amount of 0.1 to 5% by weight based on the binder.

21. The process of claim 20 wherein the heated roller used to fix the developed image has a polytetrafluoroethylene surface.

22. The process of claim 20 or 21 wherein the temperature of the heated roller in contact with the developed image is in the range of about 140° to 200° C.

* * * * *